United States Patent [19]

Toso

[11] Patent Number: 5,001,791

[45] Date of Patent: Mar. 26, 1991

[54] BACK SUPPORT WITH INTEGRAL CARRYING CASE AND STRAP LOOP CONNECTOR

[76] Inventor: Victor Toso, 842 - 22nd Ave., SE., Minneapolis, Minn. 55414

[21] Appl. No.: 575,682

[22] Filed: Aug. 31, 1990

Related U.S. Application Data

[63] Continuation of Ser. No. 416,520, Oct. 3, 1990, abandoned.

[51] Int. Cl.[5] ..... A47C 20/00

[52] U.S. Cl. ..... 5/432; 128/78; 297/464

[58] Field of Search ..... 5/432, 443, 431, 445; 128/78; 272/126, 135, 137, 143; 297/464; 190/2

[56] References Cited

U.S. PATENT DOCUMENTS

| | | | |
|---|---|---|---|
| 3,143,748 | 8/1964 | Manning | 190/2 |
| 4,190,918 | 3/1980 | Harvell | 190/2 |
| 4,627,109 | 12/1986 | Carabelli et al. | 128/78 |
| 4,738,545 | 4/1988 | Westgor | 190/2 |
| 4,773,106 | 9/1988 | Toso et al. | 5/432 |
| 4,813,080 | 3/1989 | Toso | 5/432 |

FOREIGN PATENT DOCUMENTS

| | | | |
|---|---|---|---|
| 2557780 | 7/1985 | France | 190/2 |

*Primary Examiner*—Alexander Grosz
*Attorney, Agent, or Firm*—N. J. Aquilino

[57] ABSTRACT

A back support adapted to engage the lumbar region of the wearer having a pair of straps which extend longitudinally from the ends of the support member and terminate in loops to engage the knees of the wearer when the wearer is seated on the ground or on a backless support, such as a bench or the like. The force of the wearer's knees on the straps pulls the back-supporting member against the lower back supporting it and enabling the wearer to sit upright comfortably for extended periods of time. The back support is provided with an integrally formed container pack by providing a closure member along the outside periphery of the support which, in the closed position, forms a container pack for the straps. Carrying handles are provided. The back support further includes a connector, such as a buckle, for connecting the straps, thereby keeping the knees of the user together in a more comfortable position. The back support also includes a retainer strap to attach and maintain the back support in position on the back of the user when the straps are disengaged from the knees of the user.

8 Claims, 2 Drawing Sheets

BACK SUPPORT WITH INTEGRAL CARRYING CASE AND STRAP LOOP CONNECTOR

RELATED APPLICATIONS

The application is a continuation of Ser. No. 07/416,520 filed Oct. 3, 1989, now abandoned, for BACK SUPPORT WITH INTEGRAL CARRYING CASE.

BACKGROUND OF THE INVENTION

The present invention relates to a back support device, and in particular, to a back support for supporting the lower back region of a person in a seated position, combined with an integrally formed carrying case and a strap loop connector.

In activities where an individual must be seated upright on a flat surface without a rigid back support, for example on the ground or floor, or on a backless chair, bench, and the like, sitting in this position for extended periods of time is uncomfortable, often painful and difficult, particularly for individuals with back problems. Such activities may include, but are not necessarily limited to, athletic events such as hunting, boating, camping and so forth. Other passive events such as watching athletic contests, meditating and even listening to music may cause back strain when one position is maintained for a considerable length of time. Back supporting devices which are generally similar to the present invention are shown in my prior U.S. Pat. Nos. 4,773,106 and 4,813,080, and in Japanese Ser. No. 63-251009, among others. The present invention represents an improvement over the known prior art by providing a back support combined with an integral carrying case to facilitate carrying of the device when used for various activities as described hereinabove. The outer periphery support member is provided with a suitable fastener, preferably in the form of a zipper, which permits the support to be folded back upon itself, and secured in that position forming a case structured to receive the knee-engaging straps. Handles are provided, secured to the ends of the back support member, to facilitate carrying the device when the case is in the closed position.

The back support includes a connector such as a buckle to maintain the straps together to hold the knees of the user in a more comfortable position for creating a supporting force on the lower back of the user.

Another feature includes a retainer strap for retaining the back support on the back of the user in a non-use position.

Among the objects of the present invention are the provision of a back support device which can be folded into an integrally formed carrying case when not in use, and a back support including a strap loop connector to maintain the legs of the user in a more comfortable position when the support device is being used.

These and other objects will become apparent with reference to the accompanying drawings and attached specification.

DESCRIPTION OF THE PREFERRED EMBODIMENTS

Figure 2:
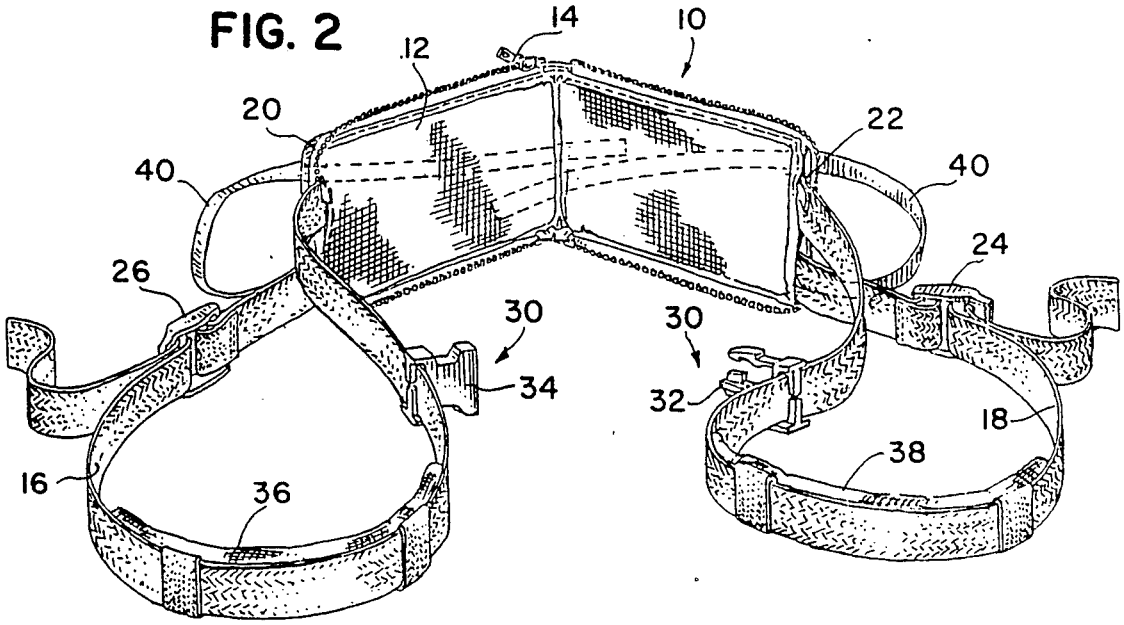
FIG. 2 is a perspective view of the invention in the open position with the straps extended.
Figure 1:
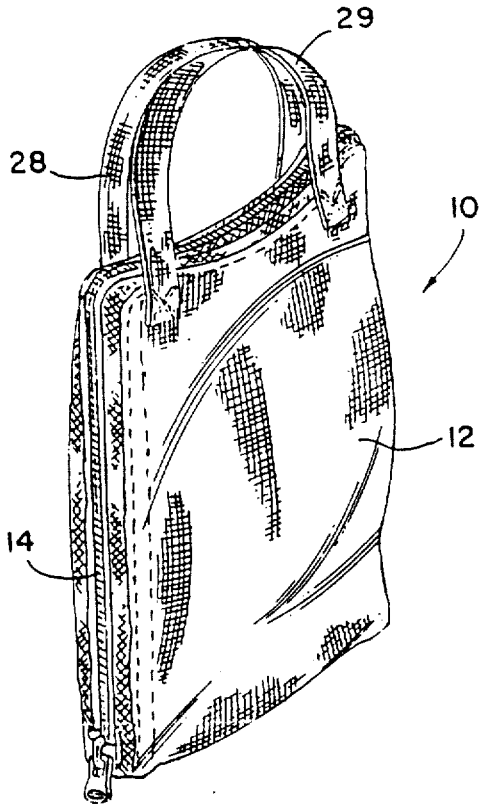
Figure 2:
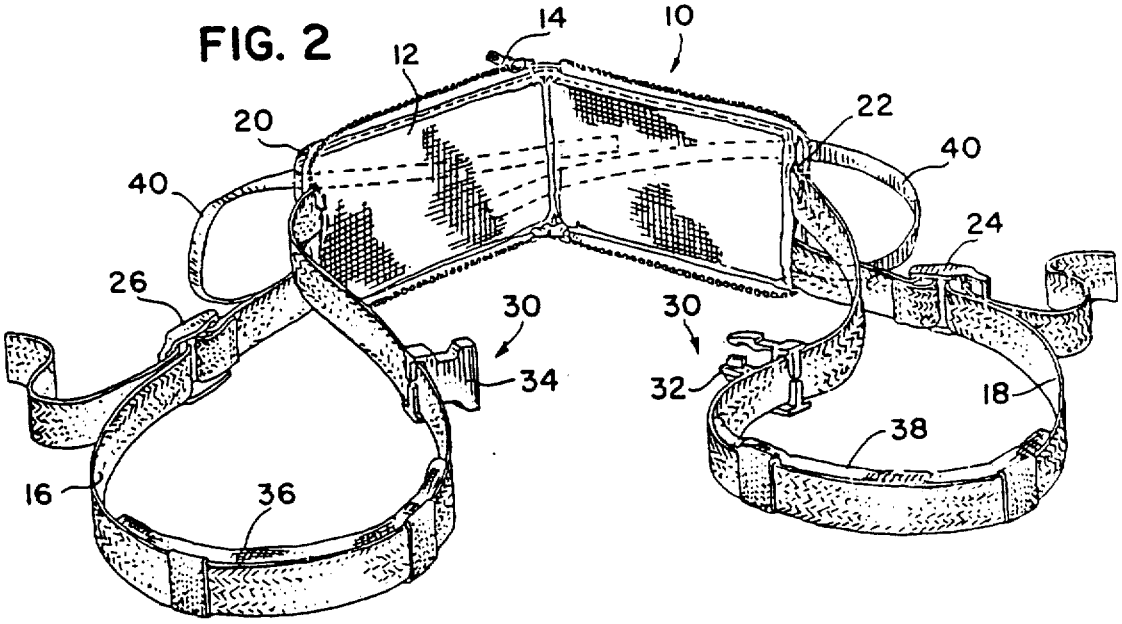

Referring to the drawings, the back support and integral carrying case 10 of the present invention is shown in the open position in FIG. 2 and includes a back support member 12 having an elongated and generally rectangular shape. The outer periphery of the support member 12 is provided with a suitable closure fastener 14 which, in the preferred embodiment, would be a zipper or similar mechanical closure. The support member 12 may be cushioned or padded and/or reinforced thus providing sufficient strength to support the wearer's lower back in use. The back support 10 is provided with a pair of elongated straps 16 and 18 which are integrally attached to the support member 12 at respective ends 20 and 22. The straps 16 and 18 form elongated loops and include buckle members 24 and 26 which permit adjustment of the length of each of the loops and which also provide a closure for securing the loops in their operative position. The straps may extend within the interior layers of the back support member 12 connecting each of the strap components 16 and 18 together. It will also be appreciated that the ends of each of the straps may terminate at the ends 20 and 22 of the back support member 12 as long as the mechanical connection between the straps and the support member is of sufficient strength to withstand the forces subjected to it during use.

Figure 15:
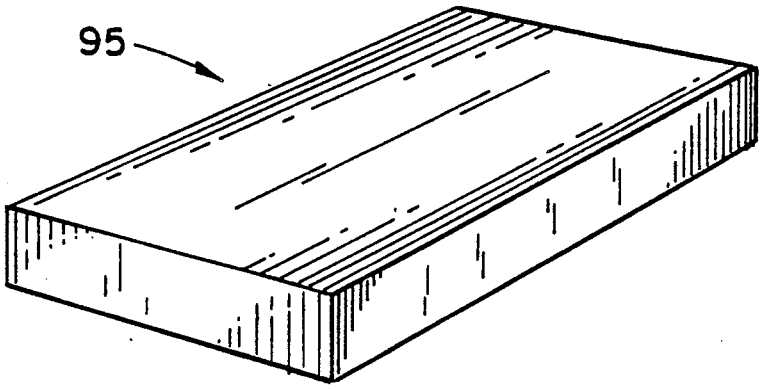
Figure 1:
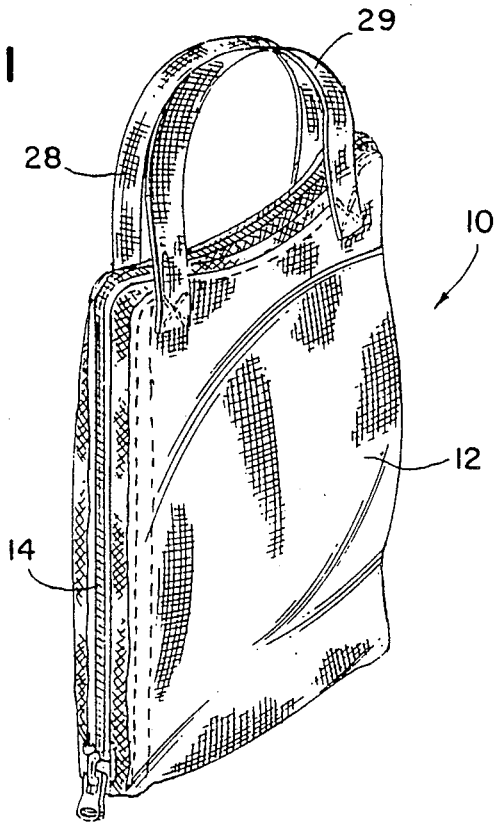
FIG. 1 is a perspective view of the back support with integral carrying case in the closed position.

Handle members 28 and 29 are provided to carry the support when it is folded upon itself to form the integral carrying case as shown in FIG. 1. In the closed position, the straps 16 and 18 are maintained within the case formed by the back support member 12.

Figure 3:
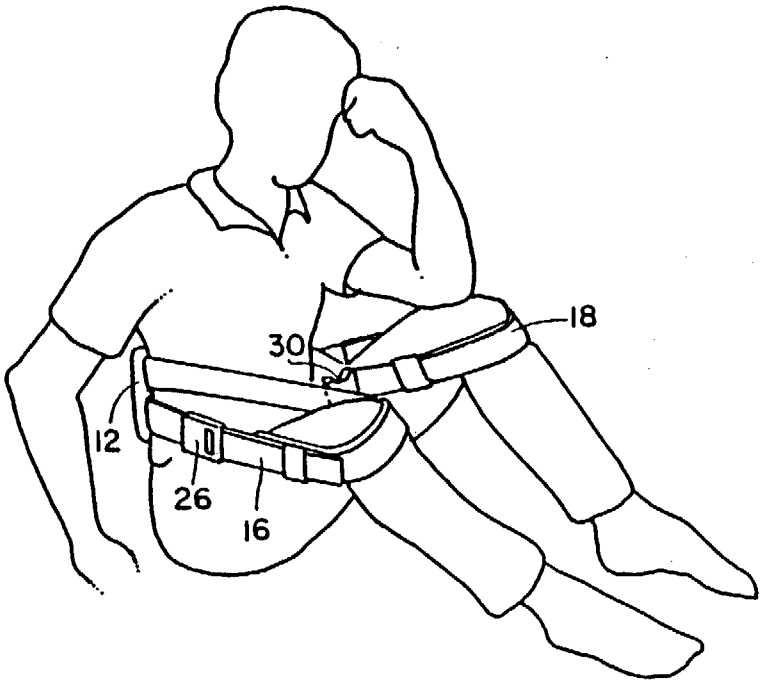
FIG. 3 is a perspective view of the back support in use.

A connector in the form of a latching type buckle 30, having a male locking member 32 and a female locking member 34, is connected to the inner sections of the straps 18 and 16, respectively. As shown in FIG. 3, when the back support member 10 is used, the buckle 30 may be latched, thereby connecting the inner loops of the straps 16 and 18 and keeping the user's knees together in a more comfortable position which further relieves the strain on the lower back and aids in positioning the support member 12 in the proper position.

It will be appreciated that other connecting means such as hooks, clips, latches, elastic bands or the like may be used with equal effectiveness to hold the strap loops together.

The straps 16 and 18 are also provided with knee pads 36 and 38 which lessen the strain on the user's knees, permitting him to exert sufficient force on the support member 12 to hold the back in a supported position.

The back support 10 also includes a retainer strap 40 which is adapted to encircle the torso of a user and to be secured in place by a suitable means such as a buckle 42 so that the back support may be worn on the user without the necessity of having the elongated straps looped over the knees to maintain the support in place. Whereas this does not provide any supporting function, it eliminates the need for repositioning the support each time that it is used and facilitates carrying the back support without the need of a separate carrying case or without continuously holding the item.

It also permits removal of the knees during activities without having to interrupt the particular activity to handle or store the back support.

Referring to FIG. 3, a user is shown wearing the back support. The support member 12 is fit against the lumbar portion of the back, and straps 16 and 18 are looped over the knees with the user in a seated position. The buckle 30 keeps the knees of the user together. Force, exerted by the knees, pulls the support member 12 against the lumbar region of the wearer's back to provide suitable support. When not in use, the straps are folded into the integrally formed carrying case as described hereinabove.

Figure 4:
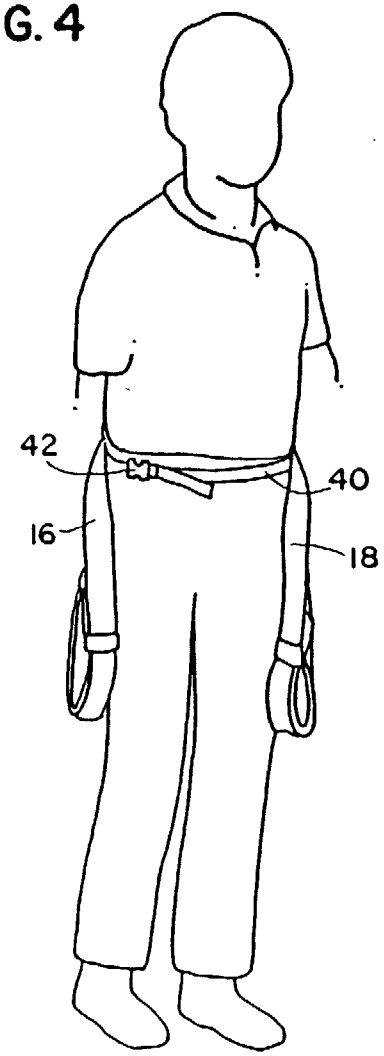
FIG. 4 is a perspective view of the back support being carried by a user in an non-use position.

FIG. 4 illustrates the back support in a non-use position where the retainer strap 40 maintains the strap in the proper position.

It will be appreciated that the above embodiments are not limiting, and that various changes may be made in the invention in keeping with the claims.

I claim:

1. A back support apparatus for supporting the lower back region of a user in a seated position comprising a generally rectangular supporting member having a length substantially spanning the width of the lower back of said user and a width substantially spanning the height of the lumbar portion of said user, elongated straps attached to and extending from the ends of said back supporting member; said straps forming loops and being of such a length to engage the knees of the user when said user is in a seated position whereby the force of said user's knees on said straps pulls said back supporting member against the back of said user, supporting the back wherein the improvement comprises:

connecting means positioned on said straps along the opposite inner section of said straps, connecting said loops and holding the legs of the user together to provide the user with more comfort while in a seated position.

2. The back support apparatus of claim 1 wherein said connecting means is a buckle slidable along said inner section of the straps.

3. The back support of claim 1 wherein said rectangular back supporting member further includes a closure integrally formed around the periphery of said supporting member whereby said supporting member may be folded upon itself and secured by said closure members forming a carrying pouch for carrying the parts of said back support apparatus in the non-use mode.

4. The back support device of claim 3 wherein said closure means is a zipper.

5. The back support of claim 1 further including knee pads on said straps to engage the knees of a user during use of the back support apparatus.

6. A back support apparatus for supporting the lower back region of a user in a seated position including a double-ended, flexible, rectangular back support member having a length substantially spanning the width of the back of the user; elongaged straps attached to and extending from the ends of said back supporting member; said straps forming loops and being of such a length to engage the knees of the user when said user is in a seated position; whereby the force of said user's knees on said straps pulls said back supporting member against the back of said user supporting the same wherein the improvement comprises:

a closure means integrally formed around the periphery of said rectangular back supporting member; said closure member permitting said back supporting member to be folded upon itself and secured by said closure means, forming a case for carrying said elongated straps therein; and means positioned on said straps along opposite inner section of said straps, connecting said loops and, holding the legs of the user together and providing the user with more comfort while in a seated position.

7. The back support of claim 6 further including a retainer strap connected to said back supporting member for attaching and maintaining said back support apparatus in position on the back of a user when said elongated straps are disengaged from the knees of the user.

8. The back support apparatus of claim 6 wherein said means positioned on said straps, connecting said loops together is a buckle slidably moveable on said straps.

* * * * *

UNITED STATES PATENT AND TRADEMARK OFFICE

CERTIFICATE OF CORRECTION

PATENT NO. : 5,001,791

DATED : Mar. 26, 1991

INVENTOR(S) : Victor Toso

It is certified that error appears in the above-identified patent and that said Letters Patent is hereby corrected as shown below:

Drawing Sheets 1 of 2 and 2 of 2 should be deleted, and substitute therefor Drawing Sheets 1 of 2 and 2 of 2, consisting of FIGS. 1, 2, 3 and 4, as shown on the attached pages.

Signed and Sealed this

Fourteenth Day of July, 1992

*Attest:*

DOUGLAS B. COMER

*Attesting Officer*

*Acting Commissioner of Patents and Trademarks*